US006186441B1

(12) United States Patent
Schneidereit

(10) Patent No.: US 6,186,441 B1
(45) Date of Patent: Feb. 13, 2001

(54) DEVICE AND METHOD FOR DETERMINING THE IMPACT POINT OF A BALLISTIC MISSILE

(75) Inventor: Ulrich Schneidereit, Donauwoerth (DE)

(73) Assignee: Eurocopter Deutschland GmbH, Donauwoerth (DE)

( * ) Notice: Under 35 U.S.C. 154(b), the term of this patent shall be extended for 0 days.

(21) Appl. No.: 09/355,864

(22) PCT Filed: Dec. 3, 1998

(86) PCT No.: PCT/DE98/03559

§ 371 Date: Aug. 4, 1999

§ 102(e) Date: Aug. 4, 1999

(87) PCT Pub. No.: WO99/30102

PCT Pub. Date: Jun. 17, 1999

(30) Foreign Application Priority Data

Dec. 4, 1997 (DE) ..... 197 53 752

(51) Int. Cl.[7] ..... F41G 7/00; F41G 7/30

(52) U.S. Cl. ..... 244/3.11; 244/3.12; 244/3.13; 244/3.14

(58) Field of Search ..... 244/3.1, 3.11, 244/3.12–3.16, 3.19; 342/62, 63, 64, 65; 701/200, 207, 223; 703/6; 345/418, 419, 421

(56) References Cited

U.S. PATENT DOCUMENTS

| | | | | |
|---|---|---|---|---|
| 3,604,897 | | 9/1971 | McAdam, Jr. et al. . | |
| 3,879,728 | * | 4/1975 | Wolff | 342/64 |
| 4,111,382 | | 9/1978 | Kissinger . | |
| 4,347,511 | * | 8/1982 | Hofmann et al. | 342/64 |
| 4,402,250 | | 9/1983 | Baasch . | |
| 4,442,431 | * | 4/1984 | Bleakney | 342/62 |
| 4,490,719 | * | 12/1984 | Botwin et al. | 342/64 |
| 4,494,198 | | 1/1985 | Smith et al. . | |
| 4,589,610 | * | 5/1986 | Schmidt | 244/3.19 |
| 4,602,336 | * | 7/1986 | Brown | 701/223 |
| 4,715,005 | * | 12/1987 | Heartz | 345/421 |
| 5,335,181 | * | 8/1994 | McGuffin | 701/200 |
| 5,465,212 | | 11/1995 | Fowler et al. . | |
| 5,801,970 | * | 9/1998 | Rowland et al. | 703/6 |

FOREIGN PATENT DOCUMENTS

| | | |
|---|---|---|
| 0610128 | 8/1994 | (EP) . |
| 1571811 | 7/1980 | (GB) . |
| 2294133 | 4/1996 | (GB) . |

OTHER PUBLICATIONS

R. R. Kumar et al. "Near–Optical Three–Dimensional Air–to–Air Missile Guidance Against Maneuvering Target" Journal of Guidance, Control and Dynamics 18(1995) May–Jun., pp. 457–464.

* cited by examiner

*Primary Examiner*—Bernarr E. Gregory
(74) *Attorney, Agent, or Firm*—W. F. Fasse; W. G. Fasse

(57) ABSTRACT

In an aiming or sighting device and an aiming method for determining the impact point of a ballistic flying body such as a rocket or a tube weapon projectile, specific characteristic values of the ballistic flying body are stored in a memory and an evaluating stage produces control signals in response to the specific characteristic values and in response to actual supplied system parameters. The control signals are transmitted to a display and to an adjustment drive. A model of the trajectory of the ballistic flying body is produced on the basis of all respective possible actual system parameters in an evaluating stage, whereby the trajectory is subdivided into at least two phases, each with a respective submodel. The submodel of the first phase is thereby a model with three or six degrees of freedom and the submodel of the second phase is a model with three degrees of freedom. An input unit permits adjusting the mode of operation and the correction of the impact location.

28 Claims, 1 Drawing Sheet

DEVICE AND METHOD FOR DETERMINING THE IMPACT POINT OF A BALLISTIC MISSILE

FIELD OF THE INVENTION

The present invention relates an apparatus and a method for determining the point of impact of a ballistic flying body, such as a rocket projectile fired from a gun also referred to as barrelled weapon.

BACKGROUND INFORMATION

The use of ballistic flying bodies such as non-guided rockets or projectiles fired from a gun regains increasing importance. For the precise delivery of a ballistic flying body such as a rovket or a projectile fired for example from an aircraft, it is necessary that the ballistic and the point of impact are ascertained. The impact point is dependent on a multitude of parameters such as attitude, position and motion status of the system from which the ballistic flying body is delivered. Additionally, the impact point is influenced by wind conditions and further characteristic values which relate to the rocket or projectile itself.

Several methods are known for determining the impact point. For example, the determination of the ballistic can be performed in that ballistic coefficients or parameters are determined ahead of time and then stored in the on-board computer of the aircraft in the form of ballistic tables. In accordance with the instantaneous system status a polynomial fit or a direct reading of the table values takes place when the weapon is used.

The above method permits, however, only a mission according to the predetermined coefficients, since the polynomial fit is based on these input values or because a direct reading only yields these values. Additionally, the required memory capacities become very large and even if the data matrix has a fine design only quantified solutions are obtained. Due to the quantified solutions the result is frequently rather imprecise. Moreover, the determination of the coefficients is very expensive. Another disadvantage lies in that the scene of the target must be completely ascertained. When an unforeseen target scene is involved, respective new ballistic tables are required, which calls for a large investment of time for the preparation of the mission.

For example, U.S. Pat. No. 4,494,198 (Smith et al.) discloses a weapons control system with a computer which comprises a first memory with convertible data for the shot distances and a second memory with correction coefficients correlated to different types of ammunition. A ballistic standard range is shown on a display. The standard range is combined with a correction factor in order to provide a corrected ballistic range.

U.S. Pat. No. 4,111,382 (Kissinger et al.) describes an apparatus for controlling a ballistic flying body in which the nominal or rated trajectory is compared with the actual flight parameters which are obtained by an inertia guidance system. A precise ballistic flight is achieved by way of a correction.

In another known method for determining the ballistics and ascertaining the point of impact, a model with three degrees of freedom is established from the actual system parameters. The term "degrees of freedom" as used herein means projectile or rocket intrinsic parameters and firing system parameters in a respective parameters model. Such parameters may include, for example, the mass center of gravity of the projectile, aerodynamic drag of the projectile and so forth. System parameters may include a helicopter downcast parameter, wind parameters and so forth. System parameters may include a helicopter downwash parameter, wind parameters and so forth. It is customary to also refer to these parameters as coefficients. In order to achieve a sufficient precision it is necessary to introduce correction factors at the beginning of the calculation. Particularly for complicated bodies, such as rockets, a multitude of correction factors are required within the model coefficient. The determination of the correction factors is very expensive and permits, just as with the above described method, only a mission based on discrete system states. Especially in connection with a rocket which is fired from a helicopter, larger interfering terms or conditions occur due to the downwash of the rotor. These interfering terms can only be corrected by respective correction factors in the three freedom degree integration model in a quantifying manner.

In order to increase the precision, it has been tried to determine the ballistics and thus the impact point by means of a six-coefficient or parameter model having 6 degrees of freedom. In such a method the flight path and the impact point are determined on the basis of six weapons specific characteristic parameters or coefficients. However, that method is very time consuming and it requires a very high computer capability. As a result, the method leads, on a mission where actual system states are involved, to time delays and thus to substantial imprecisions, especially when used in aircraft, such as combat aircraft or helicopters.

OBJECTS OF THE INVENTION

Thus, it is an object of the present invention to overcome the above discussed disadvantages and to provide an apparatus and a method for the determination of the impact point of a ballistic flying body by means of which it is possible, in different flight states, to rapidly determine the impact point with a high precision.

SUMMARY OF THE INVENTION

The apparatus according to the invention for determining the impact point of a ballistic flying body such as a rocket and/or projectile fired form a firing system such as a rocket launcher or gun comprises at least one memory for flying body specific characteristic values also referred to as first parameters of the ballistic flying body, an evaluating stage which produces control signals in response to the first parameters and in response to actually supplied second parameters representing actual firing system values, an indicator and/or control device which receives the control signals for indicating an impact point determined from the system parameters, and/or for controlling a delivery mechanism whereby a corresponding model of the trajectory of a ballistic flying body is producible in the evaluating stage. The trajectory model is divided at least into two phases each with a submodel, whereby the number of the degrees of freedom or parameters in the first phase is larger or equal to the number of degrees of freedom or parameters in the second phase.

The apparatus of the invention makes it possible to indicate weapons impact point and/or to bring the impact point with an increased precision into coincidence with a target or impact point previously selected without any required quantified provision of discrete parameters in all flight states. A prior calculation of the parameters is obviated, which reduces the expense and permits a mission in all possible scenarios without any expensive preparation. Even where other ballistic flying bodies or weapons are newly introduced, preparation time is being saved, because only the new weapons characteristic values or parameters are required to be stored in the above mentioned memory.

The method according to the invention for determining the impact point of a ballistic flying body comprises the following steps: storing specific, characteristic values or parameters such as mass center of gravity, drag and the like of the ballistic flying body in a memory; transferring actual system parameters, for example attitude and motion status of the delivery system, wind or the like, to an evaluating stage and determining of an impact point; producing of control signals for indication of the impact point and/or for controlling a delivery system for the ballistic flying body; whereby a model of the trajectory of the ballistic flying body to be delivered is produced from the specific, characteristic parameters and from the actual system parameters, said model being divided into at least two phases, each with a submodel; and whereby the number of the degrees of or parameters freedom in the first phase is larger or equal to the number of parameters in the second phase.

The method according to the invention provides the above mentioned advantages and remains unchanged even if other weapons are newly introduced and thus remains fully qualified. With the present method it is possible to precisely determine the respective trajectory of the weapon approximately without delay for each status assumed by the weapons delivery system. The method can performed in all flight status ranges and makes possible a high target precision without advance provision of quantified solutions of foreseeable flight conditions.

The submodel of the first phase has preferable six degrees of freedom which means that the submodel includes six parameters and the submodel of the second phase has preferably three degrees of freedom that is, the second submodel includes three parameters. For continuously varying system conditions at any point of time a corresponding trajectory is advantageously determined and a corresponding impact point is indicated or is adjusted to a previously fixed target. The first phase or portion of the trajectory is preferably about 1/50 to about 1/2 of the entire trajectory. A more preferred portion is within the range of about 1/30 to about 1/10 particularly about 1/20 of the entire trajectory. Advantageously the end of the first phase occurs at or after the end of the transient phase of the ballistic flying body or when the burn phase of the rocket ends. The first phase of the model ends advantageously at or after the exit of the ballistic flying body, particularly a rocket out of the rotor downwash area of a helicopter.

Advantageously, an aiming device according to the invention is coupled to an adjustment drive of a delivery system for supplying the control signal thereto, so that the impact point of the ballistic flying body to be delivered is caused to coincide with a previously determined target point. An indicator device for the aiming device may be a display, for example in a windshield or in a pilot helmet, whereby the impact point corresponding to the actual system parameters and a previously selected target point are continuously displayed.

Advantageously, the aiming device is equipped with an input for imputing of correction values for the system parameters, which serve for increasing the precision of fitting the impact point or target. Advantageously, the input makes possible a selective, multiplicative and/or additive changing of the system parameters, whereby the correction values relate advantageously to the system parameter side wind and/or rotor downwash.

Advantageously, the aiming device is provided with means for selecting the operational state of the model particularly in dependence on the respective type of the ballistic flying body and depending on the target, whereby preferably the degrees of freedom, namely the parameters as defined above particularly three and six, are randomly combinable.

BRIEF DESCRIPTION OF THE DRAWINGS

The present invention will be described in the following with reference to the accompanying drawings, wherein.

DETAILED DESCRIPTION OF A PREFERRED EXAMPLE EMBODIMENT AND OF THE BEST MODE OF THE INVENTION

Figure 1:
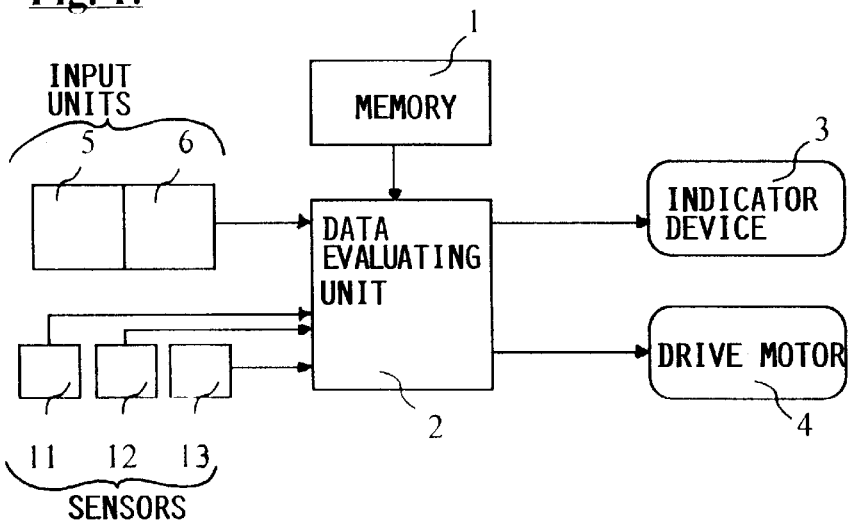
FIG. 1 shows schematically a preferred embodiment of the apparatus of the invention and its integration into an overall aiming system.

FIG. 1 shows a preferred embodiment of an aiming device according to the invention in a helicopter which is equipped with rockets and guns. The aiming system has a memory 1 in which weapons parameters also referred to as specific characteristic values of the on-board ballistic flying bodies are stored. These parameters include for example the mass and the brake coefficients or wind resistances of the rockets or gun projectiles which may be time dependent or directional dependent or may include the moments of inertia of the respective flying bodies. The memory 1 is connected to an evaluating stage 2 which produces control signals in response to the specific characteristic values of the rockets or guns and in response to further system parameters such as actually measured parameters. The evaluating stage 2 is a central processing unit which delivers the control signals to an indicator or device 3. The actual system parameters are measured by sensors 11, 12 and 13 or are ascertained by calculating units or navigational units and transmitted to the evaluating stage or unit 2. The actual system parameters comprise for example the attitude and the position of the helicopter, wind speeds or side wind coefficients, rotor downwashes and distance to the target etc.

Input units 5, 6 such as a keyboard which can be manually operated is also connected with the evaluating stage 2. The operational state may be selected through the input units 5, 6 and correction factors may be entered through this unit. When selecting the operational state, for example, a selection between air to air or air to ground operation of a rocket or a gun may be made. The input unit 5 permits entering system parameters which represent actual, current system parameters. The input unit 6 permits entering corrections of system parameters for increasing the target impact accuracy. The correction parameters for selectively correcting or changing previously entered system parameters can be entered in an additive and/or multiplicative manner.

The actual system data or system parameters are supplied to the evaluating stage 2 continuously during operation. A total model of the trajectory is formed in the evaluating stage 2 in response to the supplied weapons' specific characteristic data, or parameters the system parameters and the selection parameters for the operational state inputted through the input unit 5. The display or indicator 3 is connected through signal conductors with the evaluating stage 2. Control signals, which are produced in the evaluating stage 2 corresponding to the total model of the trajectory, control the display 3 and 1 or an adjustment drive motor 4.

Figure 2:
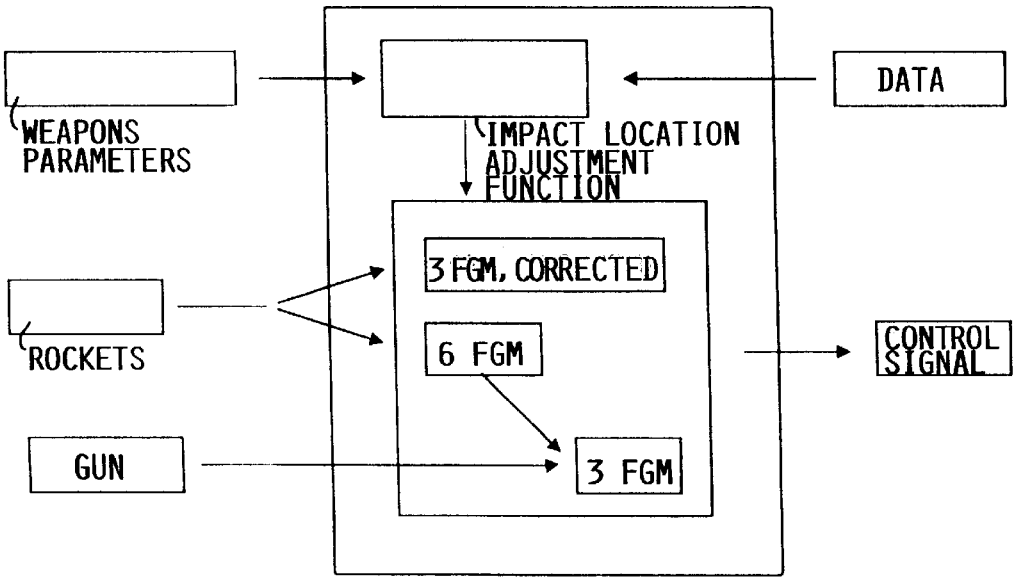
FIG. 2 is a flow diagram of the control signal generation illustrated schematically.

FIG. 2 shows schematically a flow diagram of the model generation and of the control signal generation in the evaluating stage 2. If corrections are necessary, the signals, which contain the weapons specific characteristic data and the signals which the contain the system parameters are varied in an impact location adjustment unit. The impact location adjustment unit and the corresponding impact location adjustment function will be described in more detail below. The model of the trajectory is produced from the system data or parameter and from the weapons parameters after these have passed through the impact location adjustment unit.

In case a rocket has been selected for use, a model having six degrees of freedom is produced for the first phase of the total trajectory of the rocket. However, selectively a corrected model with three degrees of freedom may be produced for the first phase of the trajectory, for example when an especially high speed for the model production is necessary. Normally, a relatively high number of degrees of freedom are provided in the first phase of the trajectory which represents the starting phase of the rocket, because in this phase the influence of interfering parameters is largest. Thus, for example during the burning phase of the rocket a transient oscillation takes place which is taken into account in the model having six degrees of freedom. Furthermore, the rocket during its starting phase is in the downwash of the main rotor of the helicopter. Depending on the produced downwash speeds, which in turn depend on the flight status and on the weight of the helicopter, the flight path or the trajectory of the rocket is influenced. A strong downwash in the starting phase of the rocket is the cause for the fact that the actual impact point is further away from the helicopter than the ascertained impact point, because the rocket turns itself in the downwash, whereby the rocket attitude is slightly tilted relative to the horizontal. In addition thereto, further disturbances occur due to vortex formations and horizontal downwash wind components, which influence the trajectory and thus the actual impact point of the rocket. Thus, the effective length of the rocket trajectory within the rotor downwash area also influences the actual trajectory of the rocket.

In order to determine the trajectory and to produce the signals which represent the actual impact point, which at the time of firing the rocket would actually occur, it is thus necessary to perform a so-called downwash correction of the disturbances caused by the rotor. Geometric corrections, blade wobble of the rotor, shading effects and swirl corrections are to taken into account in the downwash corrections. Since the effective length is dependent, among others, on the position or elevation of the drive motor 4, the respective elevation angle is sensed and taken into account in correcting the effective length of the rocket trajectory within the downwash area.

The instantaneous cross wind is also sensed and transferred in the form of crosswind signals to the evaluation stage 2. These signals are taken into account in the form of cross wind terms in the following model production. Due to the inclusion of the correction term into the model with six degrees of freedom, that model renders the trajectory of the first phase of the flight path of the rocket with a very large accuracy.

The first phase of the trajectory which is represented by the first model having six degrees of freedom ends with the burning phase of the rocket. At this point of time, the rocket has passed through its transient state and the production of the second model for the following second phase of the trajectory takes place. For this purpose a model with three freedom degrees is used, wherein three parameters are processed. The production of the model with three degrees of freedom can be accomplished with a very much smaller time consumption. The results or the trajectory values of the model with six degrees of freedom of the first phase serve as input values for the determination of the second phase of the trajectory by means of the model having three degrees of freedom for processing three parameters.

On the one hand, the precision of the ascertained impact point is much increased by the subdivision of the total model of the trajectory into two phases, each with a submodel having different degrees of freedom, because substantial interferences at the beginning of the flight phase are taken into account. On the other hand, only a small time consumption is necessary for the determination of the impact point. In the second phase, the model having only three degrees of freedom makes possible a sufficient precision because this phase is smoother and disturbances are less strongly effective on the total trajectory. For an average target distance of unguided rockets, approximately 1/20 of the trajectory determination applies to the model with six degrees of freedom, while the remaining about 19/20 apply to the second model having three degrees of freedom. Thus, a rapid and precise target or impact point determination can be performed even with the currently available processing units qualified for use in flight.

In accordance with the total model produced from the two models the signal evaluation stage or processor now produces the control signal which is transmitted to the display or indicator 3. Thus, the display continuously shows the impact point produced from the assembled submodels. The pilot or gunner has either previously selected a target or makes now the target selection. When the impact point shown in the display coincides with the selected target point and the pilot has provided for the release, the rocket is started.

For a selected target point control signals are supplied to the adjustment motors 4 of the rocket. In dependence on these control signals, the adjustment drive or adjustment motor 4 is moved in such a way that the impact point ascertained by the ballistics combined according to the invention coincides with the selected target point.

For certain flight situations and mission scenarios, the precision can, under certain circumstances, be increased by an even faster trajectory determination. For certain types of operation, such as the firing of a gun projectile, the rotor downwash has a substantially smaller influence on the flight path as for example in the case of a rocket. Thus, for certain scenarios a very high computation speed may have priority. In such a case the production of the control signals takes place on the basis of the trajectory determination by means of the model having three degrees of freedom for all phases of the flight path of the projectile. The selection of the respective type of operation is made manually through the input unit 5.

The above mentioned impact location adjustment unit and the impact location adjustment function will be described in more detail in the following. The impact location adjustment unit and function are part of a preferred embodiment of the invention. The impact location adjustment unit 6 is part of the input unit 5,6 and permits the gunner or pilot to input desired impact location changes through a keyboard. This is for example necessary when during firing a deviation between the impact point previously ascertained by means of the combined ballistics from the actual impact point is noticed. In order to correct such deviations, the control signal that is supplied by the evaluation stage to the adjustment motors 4 of the launcher is varied. For this purpose, certain input parameters at the input side of the model are so adjusted that the subsequent model produced on the basis of these parameters provides the desired impact location and the corresponding adjustment command.

Due to the variation of parameters at the input side of the evaluating unit the desired corrected impact location is valid for all distances and conditions. Thereby the downwash or rotor downdraft wind speeds are particularly suitable as parameters for the distance corrections and the cross winds term for the side corrections of the impact location. This applies to the air-to-ground mode as well as to the air-to-air mode. Thus, sensitive system parameters may be varied by an on-board input unit in order to correct the ascertained impact point. Thereby the variation of the system parameters takes place multiplicatively and/or additively through the impact location adjustment function on the input side of the evaluation stage depending on demand.

The impact location adjustment unit 6 and its function provide the possibility to influence or to correct the ascertained impact location with regard to shot range and with regard to lateral deviation, whereby the ascertained impact point is optimized. This input possibility is of great advantage for ranging a weapon as well as in the case when data from the sensors 11, 12 and 13 are not available or are disturbed or for a lot of erroneously tested gun ammunition or when the rocket motors do not function optimally. With the aid of the impact location adjustment function it is for example possible to correct the actual burn time of the rocket which due to a long storage time deviates from the specification values for a subsequent firing in order to compensate for the thus changed thrust characteristic.

According to the present invention, an impact point can be determined for any instantaneous system state. It is not necessary to rely on discrete system states as is the case for ascertaining the impact point through on-board tables. Thus, an impact point can be ascertained and indicated for continuously varying system conditions at any time without any required interpolations or a drive device can be controlled to aim a rocket at the preselected target. Furthermore, the impact point can also be ascertained in connection with unanticipated mission scenarios without any involved preparations, for example with regard to the flight elevation etc. and without the need for corresponding programming. Thus, the mission range is increased and a continuous mission preparedness is assured. Due to the ballistics combined from two submodels, the impact precision is substantially increased, whereby simultaneously a delay of the control signals relative to the actual system conditions is avoided. Indicator devices or adjustment devices subject to such delays are also avoided.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for controlling a trajectory of a ballistic flying body, said trajectory extending from a starting point in a firing system to an impact point in a target, said trajectory having at least a first trajectory phase and a second trajectory phase between said starting point and said impact point, said apparatus comprising:

a. at least one memory (1) for storing first parameters representing characteristic values of said ballistic flying body;

b. at least one input unit (5) for entering second parameters representing actual firing system values, c. a processing and evaluating unit (2) having inputs connected to said memory (1) and to said input unit (5) for receiving said first and second parameters for evaluation to produce a trajectory model including a first submodel corresponding to said first trajectory phase and a second submodel corresponding to said second trajectory phase for generating control signals for controlling said trajectory of said ballistic flying body in said first and second trajectory phases, and wherein a first number of parameters evaluated in said first submodel of said first trajectory phase is larger than or equal to a second number of parameters evaluated in said second submodel of said second trajectory phase for generating said control signals.

2. The apparatus of claim 1, wherein said first number of parameters is at least three, and wherein said second number of parameters is three.

3. The apparatus of claim 1, wherein said first number of parameters is six, and wherein said second number of parameters is three.

4. The apparatus of claim 1, wherein said first phase of said trajectory corresponds to 5% of said trajectory.

5. The apparatus of claim 1, wherein said flying body is a rocket, and wherein said first trajectory phase ends with a burn phase of said rocket.

6. The apparatus of claim 1, wherein said flying body is a rocket, and wherein said first trajectory phase has a duration longer than a burn phase of said rocket.

7. The apparatus of claim 1, further comprising a controlled drive (4) for delivering said flying body to said impact point, said processing and evaluating unit (2) further comprising a control output operatively connected to said controlled drive (4) for bringing said impact point of said flying body into coincidence with a previously determined target in response to said control signal.

8. The apparatus of claim 1, comprising a further input (6) for inputting correction system parameters to thereby selectively vary said second parameters for increasing an impact accuracy.

9. The apparatus of claim 1, wherein said at least one input unit (5) is adapted for selecting an operational state of said firing system.

10. The apparatus of claim 1, further comprising a display (3), said processing and evaluating unit (2) further comprising a display control output connected to a display (3) for displaying a rated previously selected impact point and for simultaneously displaying said impact point corresponding to said first and second parameters.

11. A method of controlling a trajectory of a ballistic flying body, said trajectory extending from a starting point in a firing system to an impact point in a target, said trajectory having at least a first trajectory phase and a second trajectory phase between said starting point and said impact point, said method comprising the following steps:

a. storing in a memory first parameters representing specific characteristic values of said ballistic flying body, b. entering second parameters representing actual firing system values into a processing and evaluating unit which also receives said first parameters from said memory, c. processing said first and second parameters for generating control signals for controlling said first and second trajectory phases of said ballistic flying body in response to said first and second parameters, and wherein said step (c) comprises:

(c1) producing a trajectory model from said first and second parameters; and (c2) dividing said trajectory model into at least two trajectory submodels including a first submodel corresponding to said first trajectory phase and a second submodel corresponding to said second trajectory phase, and wherein said first submodel is based on a first number of parameters that is larger or equal to a second number of parameters on which said second submodel is based.

12. The method of claim 11, comprising processing at least three parameters for said first submodel and processing three parameters for said second submodel.

13. The method of claim 11, further comprising continuously varying said trajectory model in response to continuously varying said second parameters representing actual firing system values for providing indicator signals representing said impact point and coinciding said impact point with a raged previously fixed impact point.

14. The method of claim 13, further comprising displaying said impact point based on said indicator signals.

15. The method of claim 13, further comprising entering correction parameters for adjusting said impact point to coincide with said previously fixed impact point.

16. The method of claim 13, further comprising the step of ending said first trajectory phase, which begins with a firing of said ballistic flying body, within one thirtieth to one tenth of said trajectory of said ballistic flying body.

17. The method of claim 11, further comprising the step of ending said first trajectory phase, which begins with a firing of said ballistic flying body, when a burn phase of said ballistic flying body is terminated.

18. The method of claim 11, further comprising the step of ending said first trajectory phase, which begins with a firing of said ballistic flying body, subsequent to termination of a burn phase of said ballistic flying body.

19. The method of claim 11, further comprising the step of ending said first trajectory phase, which begins with a firing of said ballistic flying body, when said ballistic flying body exits from a downwash of a helicopter containing said firing system.

20. The method of claim 11, further comprising the step of ending said first trajectory phase, which begins with a firing of said ballistic flying body, after said ballistic flying body exits a downwash of a helicopter containing said firing system.

21. The method of claim 11, further comprising the step of using said control signals for coinciding said impact point with a rated previously fixed impact point.

22. The method of claim 11, further comprising the step of correcting said second parameters representing actual firing system values, in response to current changes in said actual firing system values.

23. The, method of claim 22, comprising performing said correcting step as any one of an additive correction step and a multiplicative correction step.

24. The method of claim 22, wherein said step of correcting comprises selectively varying any one of said second parameters including a cross-wind parameter and a downwash parameter.

25. The method of claim 11, further comprising selecting one of an operational status and-said trajectory model depending on a type of said ballistic flying body and depending on a target, whereby said first number of parameters and said second number of parameters are randomly combinable.

26. The method of claim 25, wherein said selecting step is performed as one of an automatic selection and a manual selection.

27. The method of claim 11, further comprising displaying said control signals on a display for showing during said flight trajectory said impact point as an actual impact point in accordance with said second parameters representing actual firing system values, and simultaneously displaying a selected impact point to show deviations of said actual impact point from said selected impact point.

28. The method of claim 11, comprising processing six parameters for said first submodel and three parameters for said second submodel.

* * * * *

UNITED STATES PATENT AND TRADEMARK OFFICE

CERTIFICATE OF CORRECTION

PATENT NO. : 6,186,441 B1
DATED : February 13, 2001
INVENTOR(S) : Ulrich Schneidereit It is certified that error appears in the above-identified patent and that said Letters Patent is hereby corrected as shown below:

Title page, ABSTRACT [57]
Line 3, before "projectile", delete -- tube weapon --;
Line 7, after "parameters", insert -- referred to as second parameters --;
Line 9, before "trajectory", replace "the" with -- a --;
Line 10, after "respective", replace "possible actual systems" with -- first and second --;
Line 13, after "phrase", replace "is thereby a model with" with -- involves --;
Line 14, after "six", replace "degrees of freedom" with -- parameters --;
Line 15, after "phrase", replace "is a model with" with -- involves --;
Line 17, after "impact", replace "location" with -- point --;

Column 1,
Line 7, after "relates", insert -- to --;
Line 16, before "or", replace "rovket" with -- rocket --;

Column 3,
Line 42, after "1/10", insert -- , --;
Line 63, before "the" (first occurrence), replace "fiting", with -- hitting --;

Column 4,
Line 6, after "above", insert -- , --;
Line 11, after "following", insert -- by way of example --;
Line 37, after "or", insert -- display --;
Line 60, after "to", delete "the";
Line 61, after "parameters" (first occurrence), insert --, --;
Line 67, after "3", replace "and 1 or" with -- and/or --;

UNITED STATES PATENT AND TRADEMARK OFFICE

CERTIFICATE OF CORRECTION

PATENT NO. : 6,186,441 B1
DATED : February 13, 2001
INVENTOR(S) : Ulrich Schneidereit It is certified that error appears in the above-identified patent and that said Letters Patent is hereby corrected as shown below:

Column 5,
Line 4, after "data", insert -- or parameters --;
Line 5, after "which", delete "the";
Line 47, after "are", delete -- to --;

Signed and Sealed this

Sixteenth Day of October, 2001

*Attest:*

Nicholas P. Godici

NICHOLAS P. GODICI
*Acting Director of the United States Patent and Trademark Office*

*Attesting Officer*